US007578124B2

(12) United States Patent
Diez et al.

(10) Patent No.: US 7,578,124 B2
(45) Date of Patent: Aug. 25, 2009

(54) EXHAUST SYSTEM OF A COMBUSTION ENGINE

(75) Inventors: Rainer Diez, Nagold (DE); Frank Bühler, Mötzingen (DE)

(73) Assignee: Friederich Boysen GmbH & Co. KG, Altensteig (DE)

( * ) Notice: Subject to any disclaimer, the term of this patent is extended or adjusted under 35 U.S.C. 154(b) by 0 days.

(21) Appl. No.: 10/792,469

(22) Filed: Mar. 3, 2004

(65) Prior Publication Data

US 2004/0226291 A1 Nov. 18, 2004

(30) Foreign Application Priority Data

Mar. 10, 2003 (DE) ..... 203 03 759 U

(51) Int. Cl.
*F01N 7/10* (2006.01)

(52) U.S. Cl. ..... 60/323; 60/324

(58) Field of Classification Search ..... 60/313, 60/323, 324
See application file for complete search history.

(56) References Cited

U.S. PATENT DOCUMENTS

| | | | | |
|---|---|---|---|---|
| 3,799,196 | A * | 3/1974 | Scheitlin et al. | 137/561 A |
| 4,002,433 | A | 1/1977 | Öser | |
| 4,022,019 | A * | 5/1977 | Garcea | 60/282 |
| 4,420,933 | A * | 12/1983 | Kajitani et al. | 60/302 |
| 4,484,440 | A * | 11/1984 | Oki et al. | 60/276 |
| 4,745,742 | A * | 5/1988 | Nada et al. | 60/276 |
| 5,031,401 | A * | 7/1991 | Hinderks | 60/302 |
| 5,271,477 | A * | 12/1993 | Gekka et al. | 180/219 |
| 5,331,810 | A * | 7/1994 | Ingermann et al. | 60/322 |
| 5,689,954 | A * | 11/1997 | Blocker et al. | 60/322 |
| 5,867,985 | A * | 2/1999 | Furuhashi et al. | 60/323 |
| 6,009,706 | A * | 1/2000 | Haneda | 60/323 |
| 6,018,946 | A * | 2/2000 | Matsumoto | 60/323 |
| 6,082,103 | A | 7/2000 | Sugiura et al. | |
| 6,230,490 | B1 * | 5/2001 | Suzuki et al. | 60/323 |

(Continued)

FOREIGN PATENT DOCUMENTS

DE 296 17 304 U1 3/1998

(Continued)

OTHER PUBLICATIONS

German Search Report for German Application No. 203 03 759.6, dated Nov. 13, 2003.

(Continued)

*Primary Examiner*—Thomas E Denion
*Assistant Examiner*—Diem Tran
(74) *Attorney, Agent, or Firm*—Fitch, Even, Tabin & Flannery

(57) ABSTRACT

An exhaust system for a combustion engine which comprises at least one exhaust manifold with a plurality of inlet pipes for connection to exhaust ports of the combustion engine. The exhaust system comprises a collector device for merging of the inlet pipes, which has one outlet opening. The outlet opening is connected to subsequent elements of the exhaust system, such as catalytic converter housing. The catalytic converter inflow pipe is guided up to just before the catalytic converter; and the catalytic converter housing is connected directly to the collector housing via a pipe surrounding the catalytic converter inflow pipe. The collector device is made as a one-piece collector housing of a material stiff in bending.

22 Claims, 4 Drawing Sheets

U.S. PATENT DOCUMENTS

| | | | | |
|---|---|---|---|---|
| 6,263,669 | B1 * | 7/2001 | Kim | 60/324 |
| 6,324,838 | B1 * | 12/2001 | Stempien et al. | 60/323 |
| 6,324,839 | B1 | 12/2001 | Canini et al. | |
| 6,487,854 | B2 * | 12/2002 | Maus | 60/324 |
| 6,555,070 | B1 * | 4/2003 | Kruger | 422/179 |
| 6,609,366 | B2 * | 8/2003 | Kameyama | 60/323 |
| 6,722,126 | B2 * | 4/2004 | Kawamizu | 60/324 |
| 6,725,655 | B2 * | 4/2004 | Yoshirawa et al. | 60/323 |
| 6,745,561 | B2 * | 6/2004 | Kim | 60/323 |
| 6,925,862 | B2 * | 8/2005 | Fujita et al. | 73/118.1 |
| 6,959,543 | B2 * | 11/2005 | Havemann et al. | 60/323 |

FOREIGN PATENT DOCUMENTS

| | | | |
|---|---|---|---|
| DE | 198 19 946 | A1 | 11/1999 |
| DE | 100 51 277 | A1 | 4/2002 |
| DE | 101 44 015 | A1 | 3/2003 |
| EP | 0 733 788 | A3 | 9/1996 |
| EP | 1 013 905 | A1 | 6/2000 |
| EP | 1 247 954 | A2 | 10/2002 |

OTHER PUBLICATIONS

European Search Report for European Application No. 04 000 442.6, dated Mar. 23, 2004.

* cited by examiner

EXHAUST SYSTEM OF A COMBUSTION ENGINE

FIELD OF THE INVENTION

The present invention relates to an exhaust system of a combustion engine comprising at least one exhaust manifold with a plurality of inlet pipes for connection to exhaust ports of the combustion engine and comprising a collector device for the merging of the inlet pipes which has one outlet opening which is connected to subsequent elements of the exhaust system, in particular to a catalytic converter housing.

BACKGROUND OF THE INVENTION

The emissions exiting the outlets of a combustion engine are normally collected into one or more main exhaust lines via exhaust manifolds. The exhaust manifold has a plurality of inlet pipes for this purpose and a collector device with an outlet opening which is connected to a further-going exhaust pipe or directly to a catalytic converter. The exhaust guidance in the exhaust manifold is important for the exhaust back pressure in this process. In addition to the requirement of giving this an optimum design, it is, however, also important that there is a suitable incident flow on the so-called lambda probe required for the engine control. One goal in this process is to have an incident flow on the lambda probe with the individual emission flows of all inlet pipes which is as uniform as possible to have the same conditions for every cylinder of the combustion engine. In addition, the incident flow on a following catalytic converter should be as uniform as possible.

SUMMARY OF THE INVENTION

It is the underlying object of the invention to improve an exhaust system of the initially named kind. In particular an advantageous incident flow on the lambda probe and of the catalytic converter should be achieved. In addition, the manufacture should be as simple as possible and the stability of the exhaust system should be as high as possible.

This object is satisfied in that the collector device is made as a one-piece collector housing of a material stiff in bending.

An advantageous design of the exhaust system can be achieved by the making of the collector device as a one-piece collector housing of a material stiff in bending. In particular the manufacture can be simplified since the one-piece collector housing can, for example, be manufactured favorably by internal high pressure shaping, including necking for the pipe connection and since only simple pipes are additionally required. The collector housing has at least two, preferably three apertures for the connection of inlet pipes and one outlet opening via which the collector housing is connected to following parts of the exhaust systems.

The combination in accordance with the invention is also advantageous of a collector housing of material stiff in bending with comparatively flexible pipes which permit a length compensation due to different thermal expansion. The inlet pipes can be made relatively short so that the collector housing can be guided very closely to the exhaust ports of the combustion engine. This saves space and advantageously increases the exhaust temperature in a following catalytic converter.

It is moreover particularly preferred for the collector housing additionally to have an aperture for the insertion of a lambda probe. The lambda probe is thereby located in a space in which the exhaust flows of all inlet pipes of the exhaust system merge such that a largely uniform incident flow on the lambda probe by the different exhaust flows can be achieved. Moreover, the reshaping of the exhaust flow for the incident flow on the catalytic converter can thereby take place after the lambda probe, that is separately from the incident flow on the lambda probe. Both incident flows can be optimized separately alone by this separation.

In accordance with a further embodiment of the invention, an outlet pipe is connected to the outlet opening of the collector housing and is in particular made as a catalytic converter inflow pipe. The outlet pipe thus satisfies a dual function and a good incident flow on the catalytic converter can be achieved.

It is particularly preferred for the catalytic converter inflow pipe to be guided up to just before the catalytic converter, with the catalytic converter housing being connected directly to the collector housing via a pipe, in particular a funnel-shaped pipe, surrounding the catalytic converter inflow pipe. A double-wall exhaust guidance hereby results with a ring space formed between the outlet pipe of the collector housing and the inlet funnel of the catalytic converter which is only connected to the emission flow as a shunt. This space therefore acts as thermal insulation for the exhaust flow, whereby the exhaust temperature in the catalytic converter can in increased.

The apertures in the collector housing are stamped out at least in part in accordance with a further embodiment of the invention. The manufacture can thereby be simplified and made cheaper.

In accordance with a further embodiment of the invention, the inlet pipes open into the collector housing such that the exhaust flow directions of all exhaust flows merge at one collection point. The exhaust flow is optimized by this embodiment of the exhaust system. The possibility in particular results hereby of arranging the probe tip of the lambda probe at a point to which there is an at least substantially uniform incident flow from the individual exhaust flows of all connected inlet pipes. The engine control can thereby be improved in the desired manner.

The inlet pipes preferably open into the collector housing such that the exhaust flow directions are each inclined with respect to a plane extending perpendicular to the exhaust flow direction in the outlet opening, and indeed such that the exhaust flow directions of the inlet pipes point to the same side of this plane as the exhaust flow direction in the outlet opening. The outflow of the exhaust through the outlet opening is hereby improved and the exhaust back pressure can be reduced.

A preferred arrangement of the lambda probe is at the side of the collector housing remote from the outlet opening. The arrangement of the probe tip at the collection point of the exhaust flows can easily be achieved hereby, on the one hand, and the exhaust flow undergoes comparatively low impairment, on the other hand. This is moreover advantageous design-wise.

The inlet pipes in particular open into the collector housing such that the collection point of the exhaust flows is located in the interior of the collector housing. The incident flow on the lambda probe takes place inside the collector housing and before the realignment of the exhaust flow for the catalytic converter outflow by this embodiment. The incident flow on the lambda probe and to the catalytic converter is further improved by this separation.

The collector housing preferably has molded connection stubs for the inlet pipes and/or for the outlet pipe. This embodiment has construction advantages, on the one hand, and the assembly of the exhaust system is simplified, on the other hand. This embodiment above all permits a welding of the collector housing to the inlet pipes and to the outlet pipe on the outer side. A penetration of weld spatters into the interior of the exhaust system and the problems associated therewith, in particular the risk of an impairment of the catalytic converter, can thereby be avoided.

In accordance with a further embodiment of the invention, the collector housing is at least partly made with mirror symmetry with respect to a plane which extends perpendicular to the connection line of the exhaust ports of the combustion engine. The exhaust flow and in particular the incident flow on the lambda probe can hereby be further homogenized.

In accordance with a particularly preferred embodiment of the invention, the inlet pipes and/or the lambda probe are also arranged and made in mirror symmetry. On the one hand, the exhaust flow can hereby be even further homogenized. On the other hand, this embodiment has the advantage that the components of the exhaust system can be standardized. The same components can in particular be used for different exhaust strands. In this manner, for example with exhaust systems with two exhaust manifolds in accordance with the invention, they can be made at least partly the same despite the normally different installation situations at the different outlets of the combustion engine. Costs can be saved hereby and stock keeping simplified.

The inlet pipes are preferably provided with an oval cross-section at least section-wise. A higher forming capability of the inlet pipes is thereby achieved, by which a better length compensation can take place with different thermal expansion of the pipes.

A better forming capability for the length compensation also results when the inlet pipes are made by internal high pressure shaping in accordance with a further embodiment of the invention.

BRIEF DESCRIPTION OF THE DRAWINGS

Embodiments of the invention are shown in the drawing and will be described in the following. There are shown, schematically in each case.

DETAILED DESCRIPTION OF THE PREFERRED EMBODIMENTS

Figure 1:
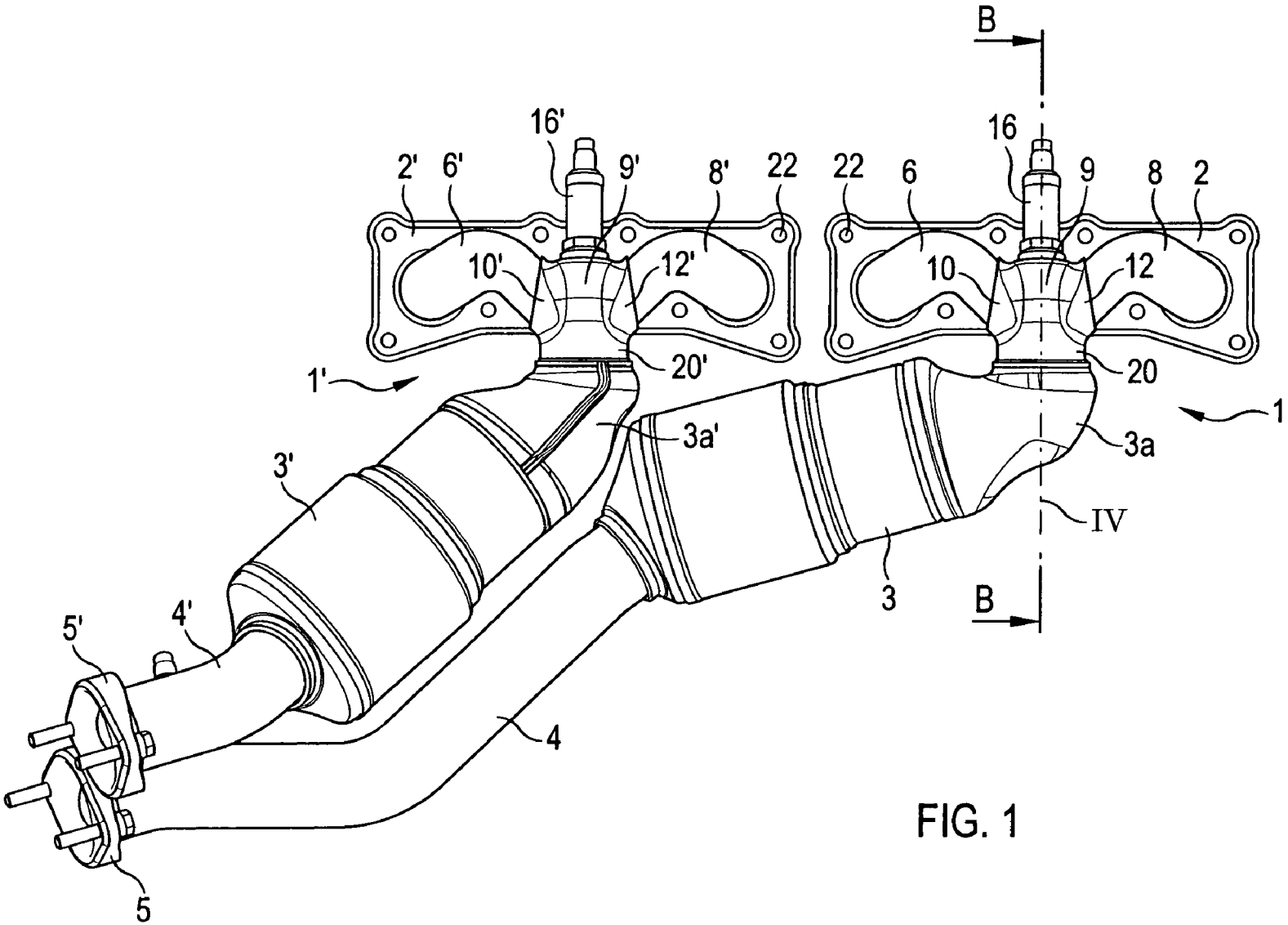
FIG. 1 a view of part of an exhaust system in accordance with the invention from a first direction.
Figure 2:
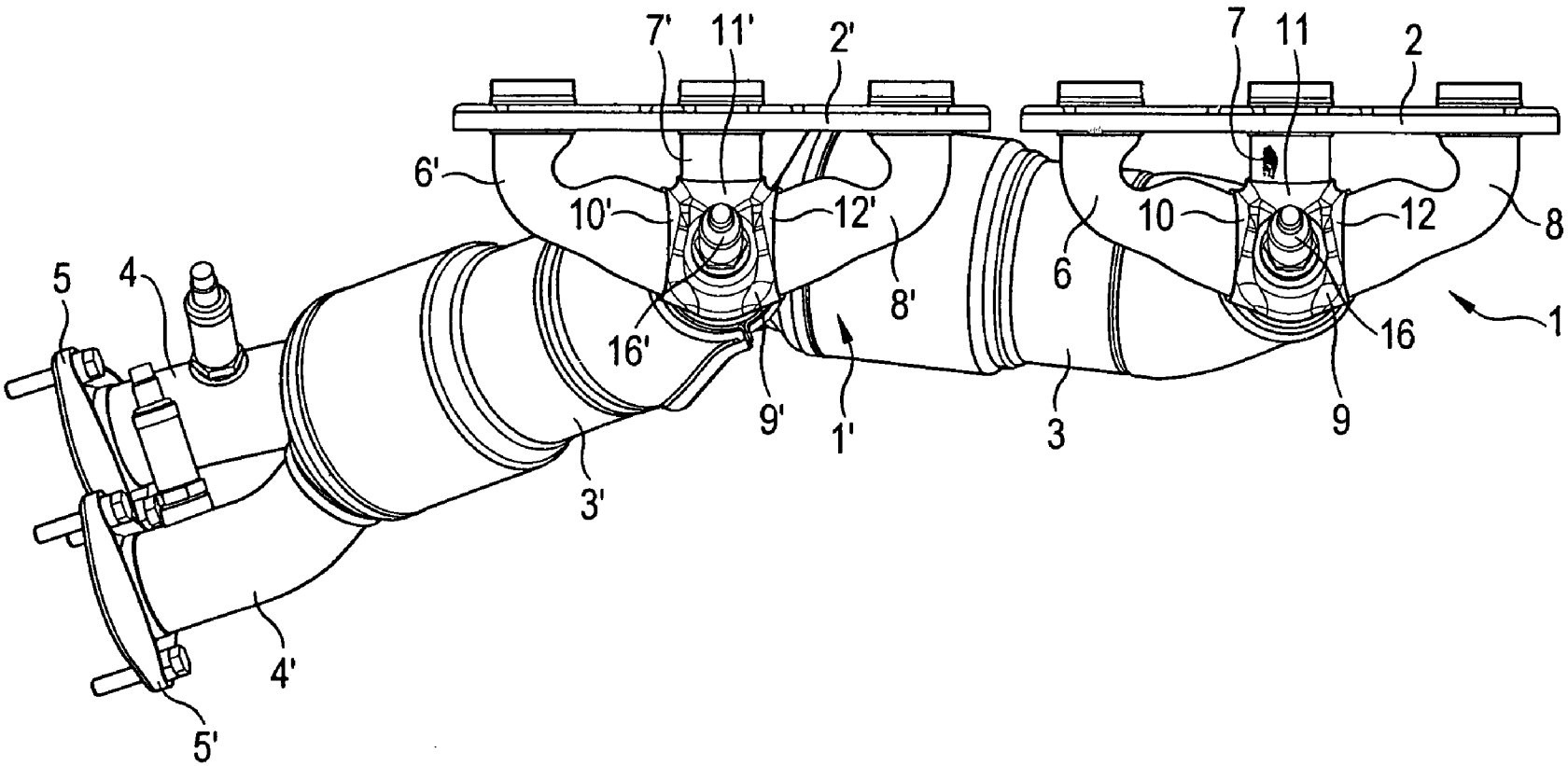
FIG. 2 a view of the part of FIG. 1 from a direction rotated through 90° with respect to it.

The exhaust system partly shown in FIGS. 1 and 2 includes two three-part exhaust manifolds 1, 1' which are connected to an engine flange 2, 2' at the inlet side and via inlet funnel 3*a*, 3*a'* to a catalytic converter housing 3, 3' at the outlet side. A furthergoing exhaust pipe 4, 4' adjoins the catalytic converter housings 3, 3' in each case and is connected in turn in each case to a flange 5, 5' for connection to a furthergoing exhaust line.

The exhaust manifolds 1, 1' each have three inlet pipes 6, 6', 7, 7' and 8, 8' of comparatively soft or flexible material which are each arranged in an aperture of the associated engine flange 2, 2' at the exhaust inlet side and are connected to a collector housing 9, 9' at the exhaust port side. The collector housing 9, 9' has walls in which connection stubs 10, 10', 11, 11' and 12, 12' are molded and is formed of comparatively stiff material.

As can in particular be recognized in FIGS. 3 to 6, the walls of the collector housing 9, 9 surround a collection space 13 into which the exhaust flows from the inlet pipes 6, 6', 7, 7', 8, 8' are guided. The exhaust flow directions I, II, III are directed to a common collection point 14 in the interior of the collection space 13. The walls of the collector housing 9, 9' moreover have a recess 15 into which a lambda probe 16, 16' is inserted. And the lambda probe 16, 16' is indeed inserted into the recess 15 such that its probe tip 17 is located in the region of the collection point 14.

Irrespective of which cylinder the exhaust actually comes from, there is thereby always an at least approximately uniform incident flow on the lambda probe 16. Substantially the same incident flow conditions thus result in all three inlet pipes 6, 6', 7, 7' and 8, 8' connected to the exhaust manifold 1, 1'. The engine control can thereby be improved accordingly.

Figure 3:
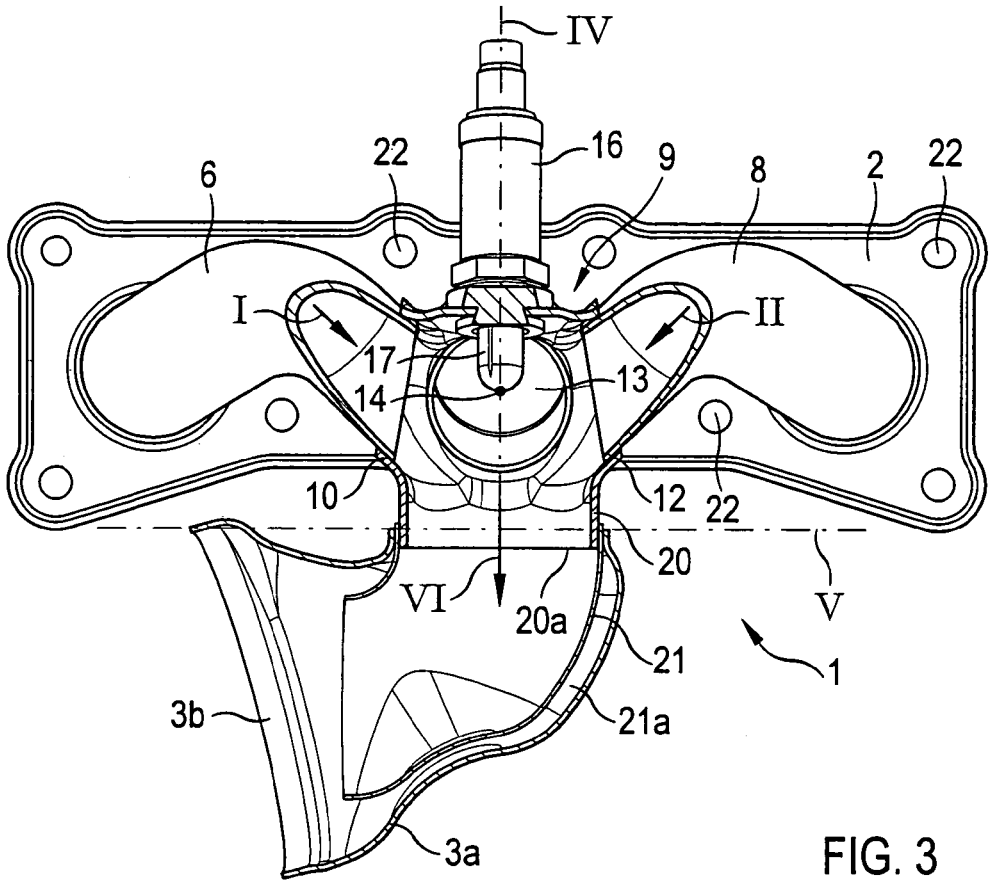
FIG. 3 a detail of FIG. 1 in an enlarged and partly sectioned representation.
Figure 4:
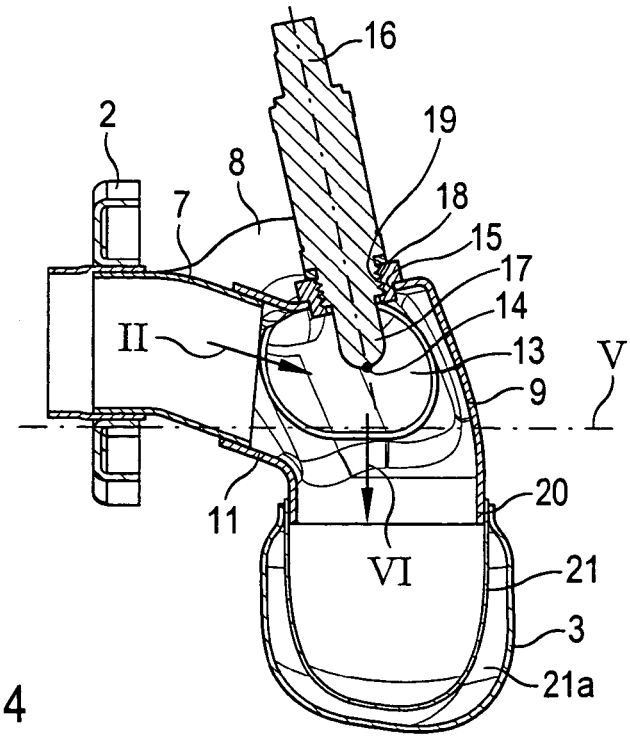
FIG. 4 a sectional view in accordance with the section line B-B in FIG. 1.
Figure 5:
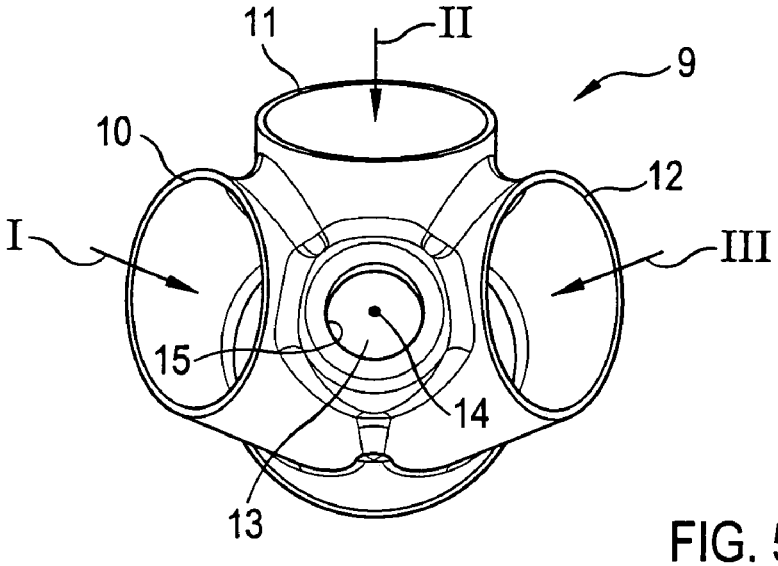
FIG. 5 a view of a collector housing of an exhaust system in accordance with the invention.

As shown in FIGS. 3 and 4, the lambda probe 16, 16' can be screwed into the recess 15. For this purpose, the lambda probe 16, 16' has an external thread 18 and the recess 15 has an internal thread 19.

Figure 6:
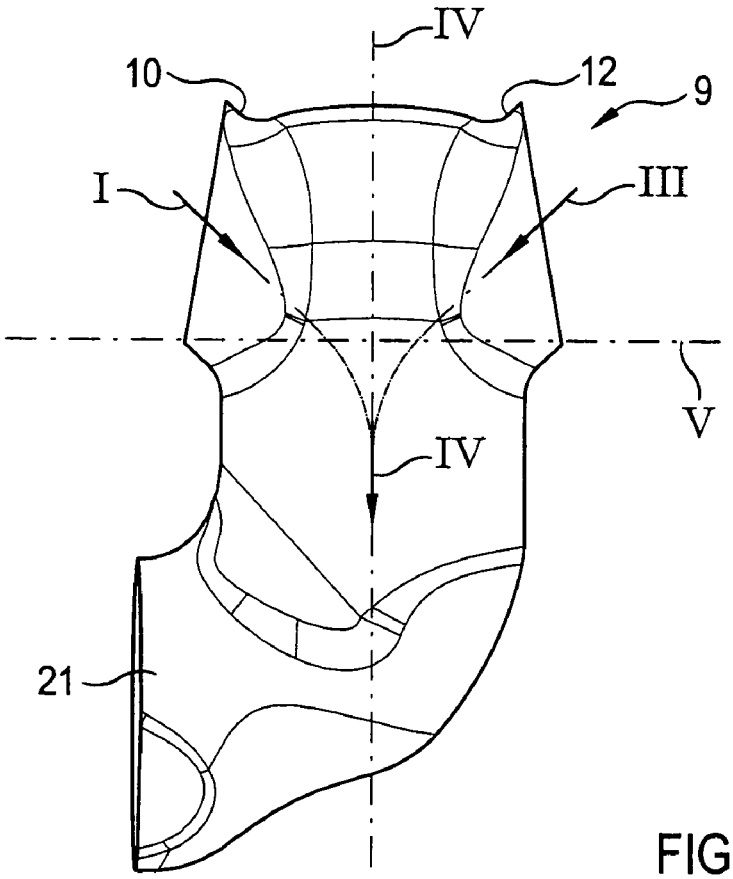
FIG. 6 a view of another collector housing of an exhaust system in accordance with the invention made in one piece with an in-flow pipe.

In addition, as can be recognized for example in FIG. 3, a connection stub 20 for an outlet pipe 21, which is in particular formed as an inflow pipe for the catalytic converter, is formed in the walls of the collector housing 9, 9' and surrounds an outlet opening 20*a*. The outlet pipe 21 can, however, as shown in FIG. 6, also be molded in one piece to the collector housing 9, 9'. In both cases, the inflow pipe 21 is made such that there is an ideal incident flow on the catalytic converter by the exhaust flow.

The inflow pipe 21 is moreover guided up to just before the catalytic converter member 3*b*. A ring space 21*a* is thereby formed between the outlet pipe 21 and the inlet funnel 3*a*, 3*a'* of the catalytic converter housing 3, 3' and is connected as a shunt to the exhaust flow and acts as insulation for the exhaust flow.

The inlet pipes 6, 6', 7, 7' and 8, 8' are each connected by welding to the collector housing 9, 9'. The same applies to the outlet pipe 21 in the variant shown in FIGS. 1 to 5, whereas in the variant shown in FIG. 6, as stated, the outlet pipe 21 is molded to the collector housing 9, 9'. The weld seam is located in each case at the outer side of the exhaust system such that no contamination can enter into the interior of the exhaust system during welding. The same applies to the welding of the inlet pipes 6, 6', 7, 7' and 8, 8,' to the engine flanges 2, 2'.

The inlet pipes 6, 6', 7, 7' and 8, 8' are each preferably manufactured by internal high pressure shaping and have an oval cross-section in a central region between their respective inlet ends and their respective outlet ends. A comparatively high shaping capability of the inlet pipes 6, 6', 7, 7' and 8, 8' results from the said type of manufacture and from this formation with an oval cross-section such that a length compensation can take place on heating.

As can be recognized in the Figures, the exhaust manifolds 1, 1' with the inlet pipes 6, 6', 7, 7' and 8, 8' and the collector housing 9, 9', but without the outlet pipe 21, are formed with mirror symmetry with respect to a plane IV which at the same time forms the longitudinal central plane of the engine flange 2, 2'. The recess 15 for the lambda probe 16 and the lambda probe 16 itself are also made with mirror symmetry with respect to this plane IV. As can be recognized, the two exhaust manifolds 1 and 1' are thereby largely identical to one another, although the furthergoing elements of the exhaust system such as the outlet pipe 21 and the catalytic converter housing 3, 3' are made differently.

The inlet pipes 6, 6', 7, 7' and 8, 8' are moreover shaped such they do not only maintain access to the boreholes 22 for the fastening of the engine flange 2, 2' to the engine block as easily as possible, but also such that the exhaust flows I, II and II extend inclined to a plane V which is perpendicular to the exhaust flow direction VI in the outlet pipe 21. The inclination is selected such that the exhaust flow directions I, II and II point to the same side of the plane V on the entry into the collector housing 9, 9' as the exhaust flow direction VI in the outlet pipe 21. A good exhaust flow guidance is thereby achieved with a low back pressure.

Overall, an exhaust system results with good exhaust flow guidance which above all combines a uniform incident flow on the lambda probe 16, 16' with a comparatively low exhaust pressure. Moreover, a better catalytic converter incident flow can be achieved, since the new build-up of the flow takes place after the lambda probe 16, 16' and both incident flows can therefore be formed separately from one another.

The combination of a collector housing 9, 9' of a comparatively stiff material and of comparatively soft inlet pipes 6, 6', 7, 7', 8, 8' is also particularly advantageous. The collector housings 9, 9' and the inlet pipes 6, 6', 7, 7', 8, 8' can each be manufactured relatively easily, with a high accuracy being able to be observed. In addition, a particularly compact arrangement with a catalytic converter close to the engine can thereby be provided.

| Reference numeral list | |
|---|---|
| 1, 1' | exhaust manifold |
| 2, 2' | engine flange |
| 3, 3' | catalytic converter housing |
| 3a), 3a' | inlet funnel |
| 3b) | catalytic converter member |
| 4, 4' | exhaust pipe |
| 5, 5' | flange |
| 6, 6' | inlet pipe |
| 7, 7' | inlet pipe |
| 8, 8' | inlet pipe |
| 9, 9' | collector housing |
| 10 | connection stub |
| 11 | connection stub |
| 12 | connection stub |
| 13 | collection space |
| 14 | collection point |
| 15 | recess |
| 16, 16' | lambda probe |
| 17 | probe tip |
| 18 | external thread |
| 19 | internal thread |
| 20 | connection stub |
| 20a | outlet opening |
| 21 | outlet pipe |
| 21a | ring space |
| 22 | borehole |
| I | exhaust flow direction |
| II | exhaust flow direction |
| III | exhaust flow direction |
| IV | central plane |
| V | plane |
| VI | exhaust flow direction |

The invention claimed is:

1. An exhaust system of a combustion engine comprising at least one exhaust manifold with a plurality of inlet pipes made of flexible material for connection to exhaust ports of the combustion engine and comprising a collector device for the merging of the inlet pipes which has one outlet opening which is connected to a subsequent catalytic converter housing, wherein the collector device is made as a one-piece collector housing of a material stiff in bending, and separate from the inlet pipes and from the subsequent housing of the catalytic converter including its inlet funnel, the flexible inlet pipes effective for permitting length compensation due to a different thermal expansion from the collector device made of stiff material, wherein an outlet pipe is connected to the outlet opening, the outlet pipe being made as a catalytic converter inflow pipe curved towards the catalytic converter.

2. An exhaust system in accordance with claim 1, wherein the collector housing has an aperture for the insertion of a lambda probe.

3. An exhaust system in accordance with claim 1, wherein the catalytic converter housing is connected directly to the collector housing via the catalytic converter inlet funnel surrounding the catalytic converter inflow pipe.

4. An exhaust system in accordance with claim 1, wherein the collector housing is manufactured by internal high pressure shaping.

5. An exhaust system in accordance with claim 1, wherein the inlet pipes open into the collector housing such that exhaust flow directions of the inlet pipes are each inclined with respect to a plane extending perpendicular to an exhaust flow direction in the outlet opening, and such that the exhaust flow directions of the inlet pipes point to the same side of said plane as the exhaust flow direction in the outlet pipe.

6. An exhaust system in accordance with claim 1, wherein the inlet pipes are manufactured by internal high pressure shaping.

7. An exhaust system in accordance with claim 1, wherein the inlet pipes have an oval cross-section, at least sectionwise.

8. An exhaust system in accordance with claim 1, wherein the collector housing has molded connection stubs for the outlet pipe.

9. The exhaust system of claim 1, wherein the inlet pipes are formed as single-walled pipes.

10. An exhaust system in accordance with claim 1, wherein the collector housing has at least two apertures for the connection of inlet pipes and has one outlet opening.

11. An exhaust system in accordance with claim 10, wherein the apertures in the collector housing are at least partly stamped out apertures.

12. An exhaust system in accordance with claim 1, wherein the inlet pipes open into the collector housing such that exhaust flow directions of all exhaust flows merge at a collection point.

13. An exhaust system in accordance with claim 12, wherein the inlet pipes open into the collector housing such that the collection point is located in the interior of the collector housing.

14. An exhaust system in accordance with claim 1, wherein a lambda probe is arranged in the collector housing such that the probe tip is located at the collection point.

15. An exhaust system in accordance with claim 14, wherein the lambda probe is arranged at the side of the collector housing remote from the outlet opening.

16. An exhaust system in accordance with claim 1, wherein the collector housing has molded connection stubs for at least one of the inlet pipes.

17. An exhaust system in accordance with claim 16, wherein the collector housing has molded connection stubs for the outlet pipe.

18. An exhaust system in accordance with claim 1, wherein the collector housing is at least partly made in mirror symmetry with respect to a plane which extends perpendicular to connection line of the exhaust ports of the combustion engine.

19. An exhaust system in accordance with claim 18, wherein at least one of the inlet pipes are arranged in mirror symmetry with respect to said plane.

20. An exhaust system in accordance with claim 18, wherein a lambda probe is arranged in mirror symmetry with respect to said plane.

21. An exhaust system in accordance with claim 19, wherein a lambda probe is arranged in mirror symmetry with respect to said plane.

22. An exhaust system of a combustion engine comprising at least one exhaust manifold with a plurality of inlet pipes made of flexible material for connection to exhaust ports of the combustion engine and comprising a collector device for the merging of the inlet pipes which has one outlet opening which is connected to a subsequent catalytic converter housing, wherein the collector device is made as a one-piece collector housing of a material stiff in bending, the collector housing having at least two apertures for the connection of inlet pipes, one outlet opening, and an aperture for the insertion of a lambda probe, the collector housing separate from the inlet pipes and from the subsequent housing of the catalytic converter including its inlet funnel, the flexible inlet pipes formed as single-walled pipes and effective for permitting length compensation due to a different thermal expansion from the collector device made of stiff material, wherein an outlet pipe is connected to the outlet opening, the outlet pipe being made as a catalytic converter inflow pipe curved towards the catalytic converter.

* * * * *